United States Patent [19]

Kasai

[11] Patent Number: 4,637,099

[45] Date of Patent: Jan. 20, 1987

[54] ADJUSTABLE STRAP FASTENER

[75] Inventor: Kazumi Kasai, Namerikawa, Japan

[73] Assignee: Nippon Notion Kogyo Co., Ltd., Tokyo, Japan

[21] Appl. No.: 813,378

[22] Filed: Dec. 26, 1985

[30] Foreign Application Priority Data

Dec. 26, 1984 [JP] Japan ..... 59-198836[U]

[51] Int. Cl.[4] ..... A44B 11/04

[52] U.S. Cl. ..... 24/200; 24/169; 24/193; 24/197

[58] Field of Search ..... 24/200, 169, 193, 197, 24/170, 182, 183

[56] References Cited

U.S. PATENT DOCUMENTS

| | | | |
|---|---|---|---|
| 157,772 | 12/1874 | Tyson | 24/169 |
| 1,656,751 | 1/1928 | Myers | 24/200 |
| 1,920,549 | 8/1933 | Clark | 24/200 |
| 2,302,258 | 11/1942 | Rose et al. | 24/197 |
| 2,316,846 | 4/1943 | Diebold | 24/200 |
| 2,981,993 | 5/1961 | Elsner | 24/170 |
| 3,192,587 | 7/1965 | White | 24/200 |
| 3,349,449 | 10/1967 | Hatfield | 24/197 |
| 4,171,555 | 10/1979 | Bakker et al. | 24/200 |
| 4,395,803 | 8/1983 | Krauss | 24/200 |
| 4,525,901 | 7/1985 | Krauss | 24/193 |

FOREIGN PATENT DOCUMENTS 54-144244 11/1979 Japan .

*Primary Examiner*—Victor N. Sakran

*Attorney, Agent, or Firm*—Hill, Van Santen, Steadman & Simpson

[57] ABSTRACT

A molded strap fastener of a generally rectangular shape includes a first cross bar for retaining therearound a looped end portion of a strap, a retainer portion disposed laterally adjacent to the cross bar and frictionally engageable with the strap end portion, and a second cross bar fixedly connected to the other strap end. The first cross bar includes a pair of diametrically opposite sharp corners and the retainer portion has a sharp corner, these sharp corners serving as stops to retain the strap in position against accidental displacement even under heavy tensioning forces. To provide a greater resistance to strap loosening, the first and second cross bars lie in different levels so that a rotational force is created upon the fastener when the latter is in actual use, said force growing greater the larger the tension and thus urging the retainer portion to firmly grip the strap end at its sharp corner. This gripping is further enhanced by the retainer portion which projects beyond the bottom surface of the fastener.

2 Claims, 7 Drawing Figures

ADJUSTABLE STRAP FASTENER

BACKGROUND OF THE INVENTION

1. Field of the Invention

This invention relates to a strap fastener for adjustably connecting a strap, belt or band to a variety of articles.

2. Prior Art

Various adjustable strap fasteners or buckles have been proposed which may be manipulated to adjust the effective length of a strap attached to for example a bag or a safety seat belt.

Advanced such fasteners are made of a plastic material formed into an integrally molded structure which generally comprises a pair of opposing side flanges, a grip end portion at one end of the side flanges, an anchor end portion at the opposite ends of the side flanges and a plurality of parallel cross bars disposed in between the grip and anchor end portions and extending transversely across and between the side flanges. In use, one end portion of a strap or the like is looped about one of the cross bars, passed under the anchor end of the fastener and secured in place as by riveting. The other end portion of the strap which is adapted for length adjustment is looped about another cross bar, passed under the grip end of the fastener and gripped therebetween against displacement. For ease of insertion of the strap between the cross bar and the grip end portion, the gap therebetween is desirably the larger the better. Conversely, however, the larger the gap, the tendency will be greater for the strap to get loose under tension. Vice versa, this tendency is less the smaller the gap, but the insertion of the strap becomes more difficult.

A proposition has been made whereby the gap defining surfaces are inclined progressively toward the reverse side of the fastener, instead of enlarging the insertion gap, as disclosed in Japanese Patent Laid-open (Kokai) Publication No. 54-144244. Such an attempt is however still not satisfactory in that the strap is more difficult to insert or otherwise manipulate.

SUMMARY OF THE INVENTION

The present invention seeks to provide an adjustable strap fastener which enables easy insertion of a strap or the like and is highly resistant to stresses tending to loosen the strap.

More specifically, the present invention seeks to provide an adjustable strap fastener which has multi-point stops to retain the strap in position against accidental movement even under heavy tensioning forces.

The present invention further seeks to provide an adjustable strap fastener which has a relatively wide opening or gap to permit insertion or adjustment of the strap with utmost ease.

A molded strap fastener of a generally rectangular shape includes a first cross bar for retaining therearound a looped end portion of a strap, a retainer portion disposed laterally adjacent to the cross bar and frictionally engageable with the strap end portion, and a second cross bar fixedly connected to the other strap end. The first cross bar includes a pair of diametrically opposite sharp corners and the retainer portion has a sharp corner, these sharp corners serving as stops to retain the strap in position against accidental displacement even under heavy tensioning forces. To provide a greater resistance to strap loosening, the first and second cross bars lie in different levels so that a rotational force is created upon the fastener when the latter is in actual use, said force growing greater the larger the tension and thus urging the retainer portion to firmly grip the strap end at its sharp corner. This gripping is further enhanced by the retainer portion which projects beyond the bottom surface of the fastener.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

FIGS. 1 through 7 show an adjustable strap fastener generally designated 10 according to the present invention.

Figure 1:
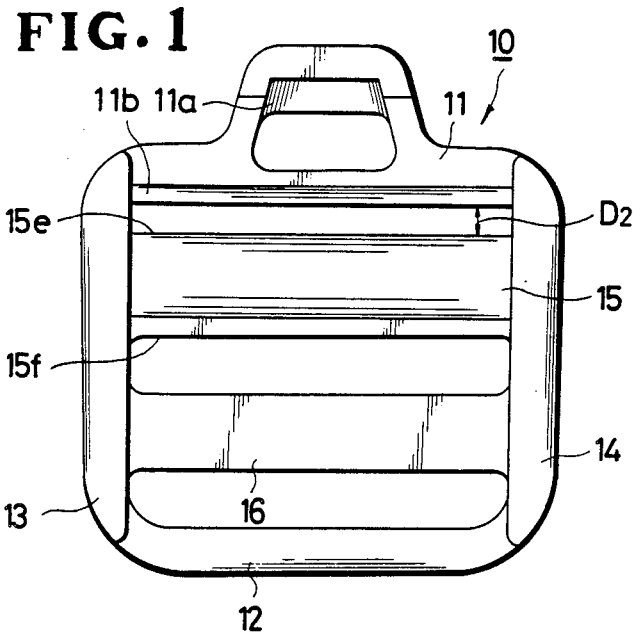
FIG. 1 is a front plan view of an adjustable strap fastener according to the present invention.
Figure 2:
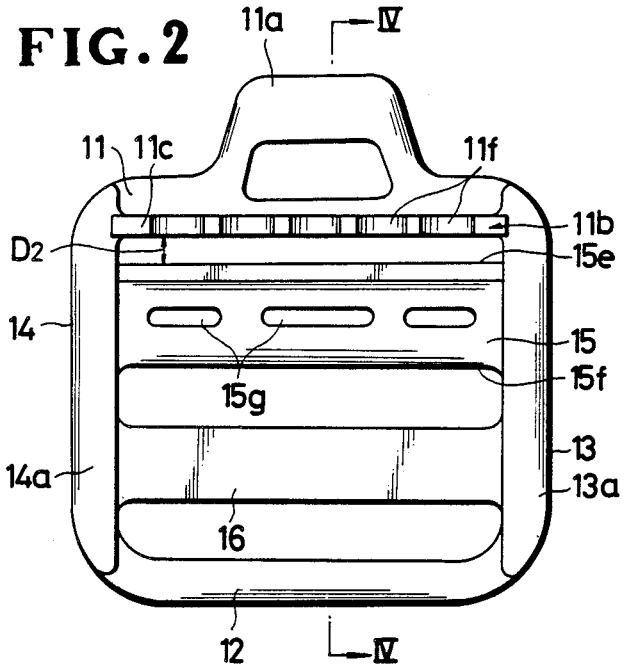
FIG. 2 is a bottom plan view of the strap fastener of FIG. 1.
Figure 3:
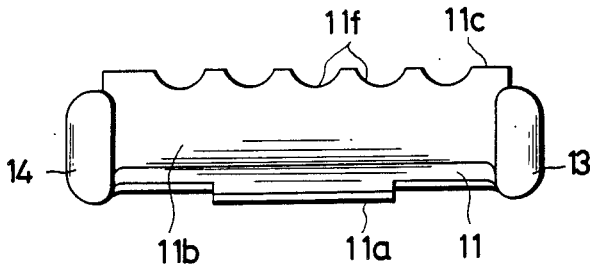
FIG. 3 is a end elevational view of the strap fastener of FIG. 1.

The strap fastener 10 is made of a plastic material formed into an integral molded construction generally rectangular in shape as shown in FIGS. 1 and 2. The strap fastener 10 comprises a grip head portion 11 at one of its end, a connecting portion 12 at the other ends, a pair of opposed side flange portions 13, 14 extending longitudinally between opposite ends of the head portion 11 and the connecting portion 12, a first or strap turn-over cross bar 15 adjacent to the head portion 11 and a second or strap anchoring cross bar 16 adjacent to the connecting portion 12, the cross bars 15 and 16 extending in spaced parallel relation to each other between and connected to the opposed side flanges 13 and 14.

Figure 4:
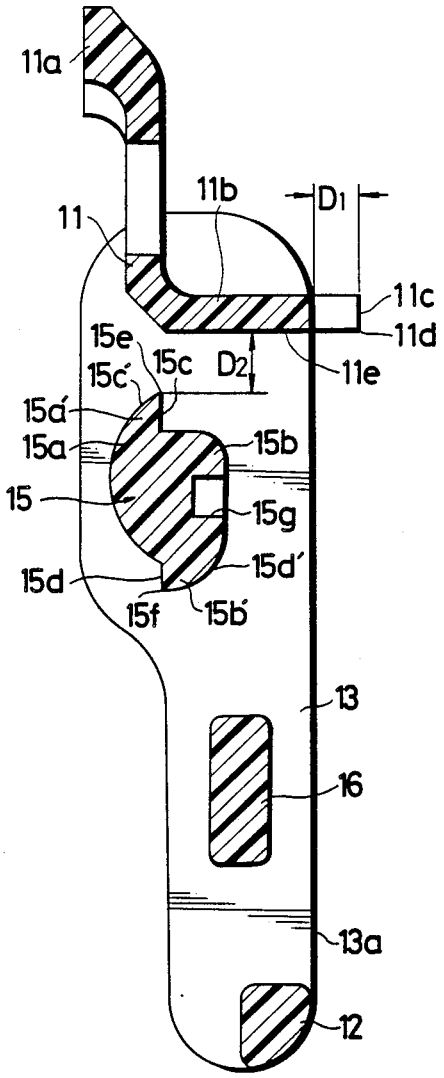
FIG. 4 is a cross-sectional view on enlarged scale taken along line IV—IV of FIG. 2.

The head portion 11, as better shown in FIG. 4, includes an apertured flared projecting tab 11*a*, and a strap retainer portion 11*b* extending therefrom downwardly substantially at a right angle to the plane of the fastener 10 adjacent to the first cross bar 15, the retainer portion 11*b* terminating with a flat bottom end surface 11*c* projecting a small distance $D_1$ beyond the bottom surfaces of the opposed side flanges 13, 14 for reasons hereafter to be described. The retainer portion 11*b* has a sharp corner 11*d* defined by the flat bottom surface 11*c* and a flat side surface 11*e* which extends perpendicularly to the general plane of the fastener 10. The sharp corner 11*d* serves as a first strap stop as later described. The connecting portion 12 has a lowermost surface lying flush with the flat bottom surfaces 13*a*, 14*a* of the flange portions 13, 14.

The strap anchoring bar 16 is positioned slightly above the connecting portion 12 as viewed from the side elevation or as shown in FIG. 4. The strap turn-over bar 15 is positioned slightly above the anchoring bar 16 and closer to the upper surface of the flanges 13, 14 so as to make the strap S between the turn-over bar 15 and the bottom surface 11c run substantially parallel with the retainer portion 11b or at a right angle to the general plane of the fastener 10.

The turn-over bar 15, as better shown in FIG. 4, includes a pair of integral top and bottom portions 15a, 15b displaced from one another in a direction parallel to the side flange portions 13 so as to provide a pair of first and second projections 15a', 15b'. The first projection 15a' extends toward the grip head portion 11 and terminates in a second sharp corner edge 15e which is defined jointly by a flat bottom surface 15c and an arcuate top surface 15c', while the second projection 15b' extends toward the connecting portion 12 and terminates in a third sharp corner edge 15f which is defined jointly by a flat top surface 15d and an arcuate bottom surface 15d'. The flat bottom surface 15c of the first projection 15a' and the flat top surface 15d of the second projection 15b' extend in opposite directions from substantially the midpoint of the thickness of the bar 15 and in a plane substantially parallel to the general plane of the fastener 10. The second sharp corner edge 15e is spaced from the vertical plane of first sharp corner edge 11d by a distance $D_2$ larger than the thickness of the strap S to facilitate insertion of the latter. The second and third sharp corner edges 15e, 15f serve respectively as second and third stops to retain the strap S thereof against unintentional movement. The turn-over bar 15 includes a plurality of elongated recesses 15g extending along the bottom portion 15b at longitudinal intervals for saving the amount of plastic material used.

Figure 7:
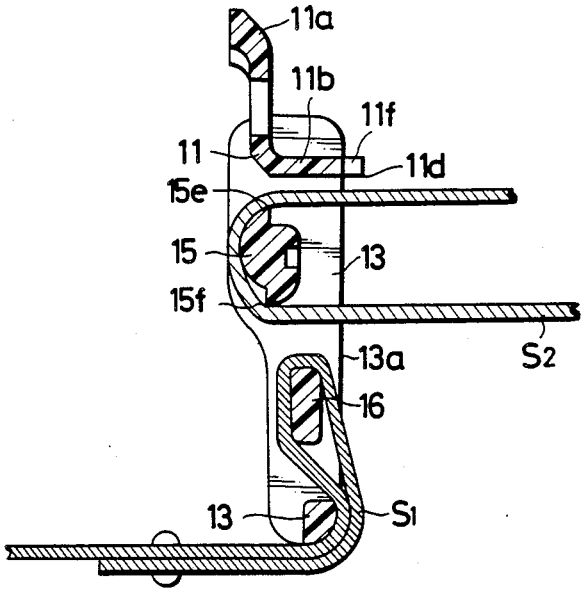
FIGS. 5, 6 and 7 are schematic views utilized to explain the operation of the fastener associated with the strap.
Figure 5:
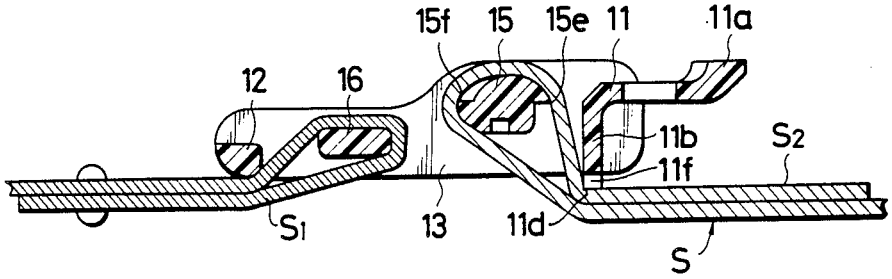
Figure 6:
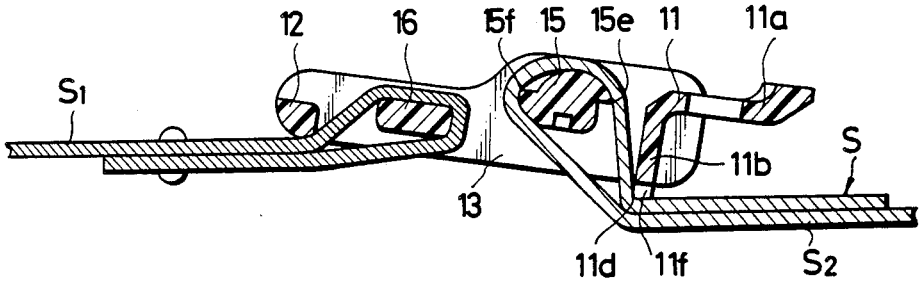

FIGS. 5–7 show the behavior of the strap or belt S with respect to the fastener 10, in which the strap S is inserted into the strap fastener 10, first with one of its ends $S_1$ looped about the anchoring bar 16 and passed underneath the connecting portion 12, the extension of the strap S at this end being secured in place as by riveting or stitching. The other end of the strap $S_2$ is looped about the turn-over bar 15 and passed underneath the retainer portion 11b of the head 11, in which instance the leading end portion of the strap $S_2$ is brought into contact with the flat bottom surface 11c of the grip head portion 11.

While the strap end $S_1$ is held stationary, the strap end $S_2$ is adjustable in length to suit the particular application. This adjustment may be made by pulling out the leading strap end $S_2$ to thereby shorten the effective length of the strap S, or by rotating the fastener 10 counter-clockwise about the connecting portion 12 as shown in FIG. 7 to release the strap end $S_2$ and pulling the strap S out to thereby shorten or shoving the strap in to thereby lengthen the effective length of the strap S as desired. This rotation can be done most conveniently by handling the flared tab 11a of the grip head 11.

The strap fastener 10 thus constructed is, as shown in FIGS. 5 and 6, provided with multi-point stops, namely, at corners 11d, 15e and 15f along the path of the strap $S_2'$, so that the strap S is firmly held in place against shifting which would otherwise occur under the influence of heavy stresses applied in use.

The relative positions, in which the turn-over bar 15 lies at a level above the anchoring bar 16 and the anchoring bar 16 lies above the connecting portion 12 in a cascade fashion, create a clockwise rotational force upon the strap fastener 10 when in actual use as shown in FIG. 6, such force growing greater the larger the tension and thus urging the retainer portion 11b to firmly grip the strap $S_2$ at the first stop 11d.

At the same, this gripping is further enhanced by the fact that a run of the strap S between the projecting surface 11c of the head 11 and the turn-over bar 15 is substantially parallel with the vertical retainer portion 11b, that is, substantially perpendicular to the general plane of the strap fastener 10, so that the strap $S_2$ is also caught and gripped by the second stop 15e. To further ensure firm retention of the strap S, the bottom end surface 11c of the retainer portion 11b is corrugated to have a plurality of grooves 11f extending parallel to the flanges 13, 14, thereby imparting frictional grip upon the strap S.

The multi-point stop arrangement (11d, 15e and 15f) together with the presence of added length $D_1$ of the retainer portion 11b will permit an increase in the space $D_2$ for passage of the strap S whereby it is rendered extremely easy to thread the strap S through the fastener 10.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A strap fastener molded of a plastic material for adjustably connecting ends of a strap, comprising:

(a) a grip head portion;

(b) a pair of parallel spaced side flanges extending from said grip head portion in a common direction and having a pair of flat bottom surfaces, respectively;

(c) a connecting portion extending between and interconnecting said side flanges;

(d) a pair of parallel spaced first and second cross bars extending parallel to said connecting portion and connected to said side flange portions, said first cross bar being disposed closer to said grip head portion than said second cross bar;

(e) a retainer portion extending integrally from said head portion perpendicularly to the plane of the fastener and projecting beyond said bottom surfaces of said side flanges, said retainer portion having a flat bottom surface and defining a first strap stop;

(f) said first cross bar having a first projection extending toward said grip head portion and defining a second strap stop and further having a second projection extending toward said connecting portion and defining a third strap stop, said retainer portion and said second strap stop being spaced from one another by a distance larger than the thickness of the strap; and (g) said first cross bar lying at a level above said second cross bar, said second cross bar lying at a level above said connecting portion, said connecting portion having a lowermost surface lying flush with said bottom surfaces of said flanges.

2. A strap fastener according to claim 1, said bottom surface of said retainer portion having a plurality of grooves extending parallel to said flanges.

* * * * *